United States Patent [19]

Nakamura et al.

[11] Patent Number: 4,464,609

[45] Date of Patent: Aug. 7, 1984

[54] FLASH LIGHTING UNIT FOR A CAMERA

[75] Inventors: Zenzo Nakamura, Saitama; Takashi Uchiyama, Yokohama; Shohei Ohtaki, Yokohama; Tokuichi Tsunekawa, Yokohama; Masanori Uchidoi, Yokohama; Yukio Mashimo, Tokyo, all of Japan

[73] Assignee: Canon Kabushiki Kaisha, Tokyo, Japan

[21] Appl. No.: 551,491

[22] Filed: Nov. 14, 1983

Related U.S. Application Data

[63] Continuation of Ser. No. 199,476, Oct. 22, 1980, abandoned, which is a continuation of Ser. No. 920,646, Jun. 30, 1978, abandoned, which is a continuation of Ser. No. 728,163, Sep. 30, 1976, abandoned.

[30] Foreign Application Priority Data

Oct. 2, 1975 [JP] Japan ..... 50-119389

[51] Int. Cl.[3] ..... H05B 41/14; G03B 15/05

[52] U.S. Cl. ..... 315/241 P; 354/416; 354/418

[58] Field of Search ..... 354/127.1, 127.11, 127.12, 354/145.1, 418; 315/241 P

[56] References Cited

U.S. PATENT DOCUMENTS

| | | | |
|---|---|---|---|
| 3,638,543 | 2/1972 | Kondo | 354/35 |
| 3,919,593 | 11/1975 | Nakamura | 315/241 P |
| 3,997,815 | 12/1976 | Decker | 315/241 P |
| 4,047,194 | 9/1977 | Nakamura et al. | 354/149 |

*Primary Examiner*—William B. Perkey

*Attorney, Agent, or Firm*—Toren, McGeady and Stanger

[57] ABSTRACT

A voltage detecting means is provided in a flash lamp firing circuit for detecting the attainment of the voltage of a storage capacitor to a satisfactory lamp firing voltage level to assure that a photographic camera associated with the flash lighting unit operates in a flash exposure range switched from a daylight exposure range only when a sufficient voltage is available to fire the lamp at the time of striking of the lamp. In one embodiment, the detecting means comprises two transistorized circuits having output terminals one of which is connected to the gate lead of a SCR in a discharge circuit of the lamp, and another output terminal which is arranged to be connectable to a light-emitting diode of the camera and therefrom connected to the gate lead of an electronic change-over switch for selection of the operating ranges of the camera, the light-emitting diode being arranged to be visible from the outside of the camera so that the operator is immediately aware if the storage capacitor voltage has attained the satisfactory firing level.

3 Claims, 4 Drawing Figures

FLASH LIGHTING UNIT FOR A CAMERA

This is a continuation of application Ser. No. 199,476, filed Oct. 22, 1980, which is a continuation of application Ser. No. 920,646, filed June 30, 1978, which is a continuation of application Ser. No. 728,163, filed Sept. 30, 1976, all now abandoned.

BACKGROUND OF THE INVENTION

1. Field of the Invention:

This invention relates to flash lighting units for photographic cameras, and more particularly to an improved flash lamp firing circuit for securing the reliability of operation of a flash lamp in a manner not to fire the lamp before the camera is made ready for flash photography regardless of the striking of the lamp.

2. Description of the Prior Art:

It is known to provide a flash lamp firing circuit having means capable of switching the associated camera from a day-light exposure range to a flash exposure range in automatic response to the attainment of the voltage of a storage capacitor to a satisfactory lamp firing level. As far as is known, however, the conventional types of circuits as such are characterized by the lack of means for preventing the lamp from being fired when the striking of the lamp is caused to occur before the voltage of the storage capacitor reaches the satisfactory firing level, though it is above a critical breakdown voltage level of the lamp. It has often happened that the camera is caused to operate in the day-light exposure range with the flash lighting unit being effective. It is, therefore, resulted that when the effective exposure time is relatively shorter, the magnitude of the exposure will be varied in different regions of an image. In the case of longer exposure times, the photographic film is over-exposed by an amount proportional to the total energy of flash light produced from the fired lamp.

SUMMARY OF THE INVENTION

The present invention has for a primary object to eliminate the above mentioned conventional drawbacks and to provide a flash lamp firing circuit having means capable, upon attainment of the voltage of a storage capacitor to a satisfactory lamp firing level, of switching an associated camera from a day-light exposure range to a flash exposure range and, at the same time, of completing a discharge circuit for the lamp, whereby the camera is made ready for flash photography with the satisfactory voltage being available to fire the lamp at the time of striking of the lamp.

An object of the invention is to provide a flash lighting unit adapted for use with a camera having diaphragm control means made effective in automatic response to the attainment of the voltage of a storage capacitor to a satisfactory lamp firing level.

Another object of the invention is to provide a flash lighting unit for a camera with a luminous diode positioned to be visible from the outside of thereof so that the operator is immediately aware if the voltage of a storage capacitor has reached a satisfactory lamp firing level.

DETAILED DESCRIPTION OF THE PREFERRED EMBODIMENTS

Figure 1:
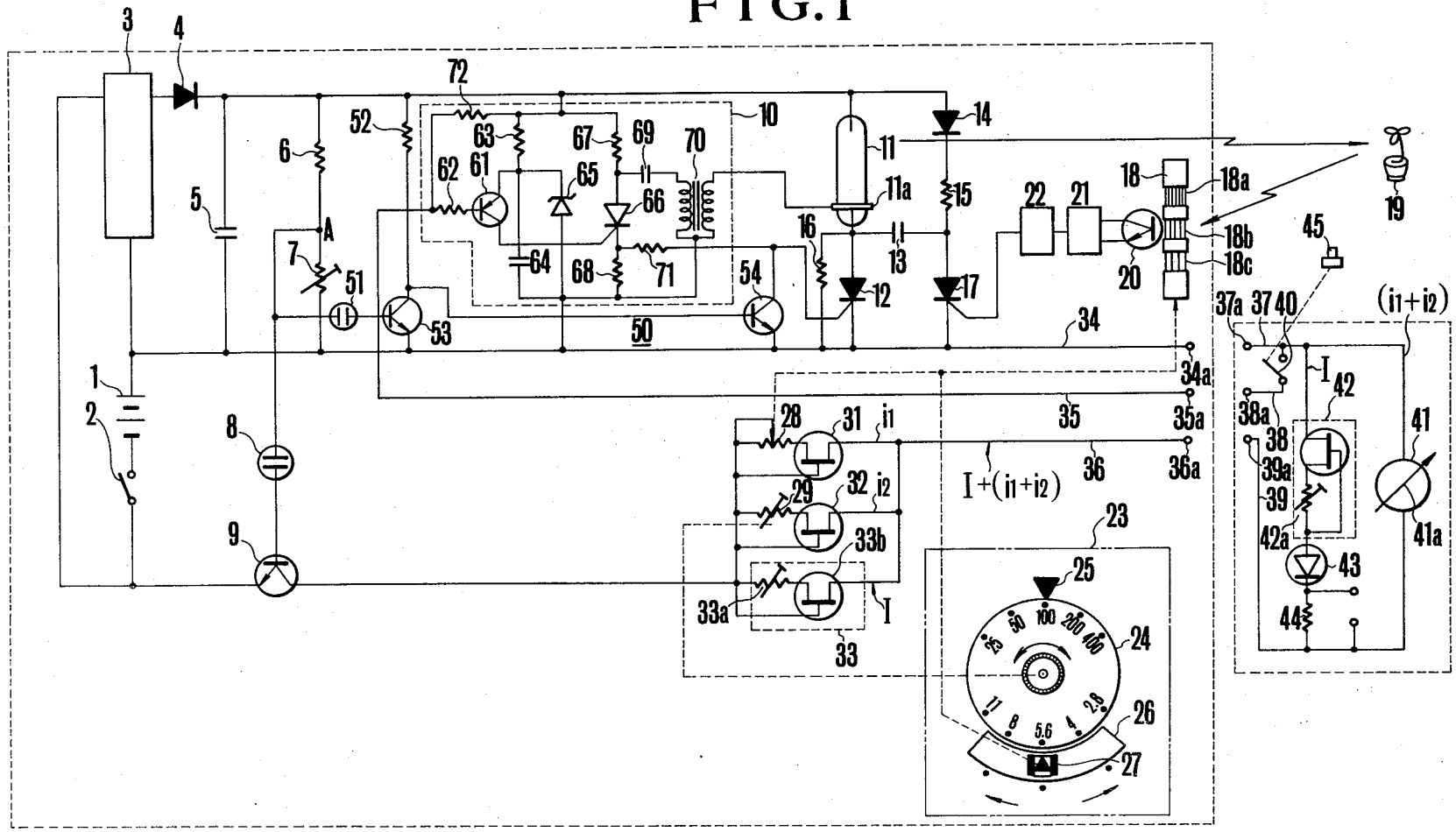
FIG. 1 is a circuit diagram, partly in block form, of one embodiment of a flash lighting unit according to the present invention adapted for use with a photographic camera having diaphragm control means of the character described.

Referring to FIG. 1, one embodiment of a flash lamp firing circuit according to the present invention is shown in a dashed outline F as adapted for use with a diaphragm control circuit enclosed by dashed lines C provided in a camera for daylight and flash photography. The flash lamp firing circuit F includes a voltage source 1 which may constitute a DC source or battery connected through a voltage boosting means 3 and a diode 4 to charge a storage capacitor 5, a striking or control circuit 10 enclosed within a dashed outline (10), and a gas discharge lamp 11. The lamp 11 includes a trigger electrode **11*a* connected to an output terminal of the striking circuit 10, an anode connected to the positive side of the storage capacitor 5 by way of a positive bus, and a cathode connected through a silicon controlled rectifier or SCR to a negative side of the storage capacitor 5 by way of a negative bus 34 so that the voltage stored on the capacitor 5 appears across the lamp 11 when SCR 12 is closed. In order to terminate the duration of firing of the lamp 11 at a time when the integrated flash light energy has reached a predetermined level dependent upon the total amount of flash light reflected from an object 19 being photographed with flash illumination as sensed by a photosensitive element 20 positioned behind a filter 18, there is provided a commutation capacitor 13 connected at one side to the cathode of the lamp 11, the opposite side of which is connected through a SCR 17 to the negative bus 34. The gate electrode of the SCR 17 is connected to the output terminal of an operational amplifier 22 having an input terminal connected to the output terminal of an integrator 21 with the photosensitive element 20. One diode 12 and two resistors 15 and 16 comprise a charging circuit for the commutation capacitor 13**.

The striking circuit 10 comprises a transistor 61 having a base electrode connected throgh a resistor 62 to an interconnection terminal **35*a* by way of a lead 35, the terminal 35*a* being arranged to be connectable with a synchro-switch 40 when the flash unit is attached to the camera, and having an emitter electrode connected to a point on connection between a resistor 63 and a capacitor 65, a Zener diode 65 connected across the capacitor 64, a thyristor 66 having a gate electrode connected to the collector electrode of transistor 61, having an anode connected through a resistor 67 to a common lead of the resistor 63 and therefrom connected to the positive bus, and having a cathode connected through a resistor 68 to a common lead of the capacitor 64 and therefrom connected to a common lead of primary and secondary coils of a transformer 70, the opposite lead of the secondary coil being connected to the trigger electrode of the flash lamp 11, a capacitor 69 connected between the anode of thyristor 66** and the primary coil of the transformer 70, a resistor 71 connected betweem the cathode of the thyristor 66 and the gate electrode of the SCR 12, and a resistor 72 connected between the resistors 62 and 63.

A voltage detecting means of the invention is provided in the lamp firing circuit, and comprises first and second transistorized circuits with a common voltage divider comprising a fixed resistor 6 and a variable resistor 7. The first voltage detecting circuit further includes a neon tube 51, a first transistor 53 having a base electrode connected through the neon tube 51 to a junction point A of the resistance voltage divider 6, 7, having a collector electrode connected through a resistor 53 to the positive bus, and having an emitter electrode connected to the negative bus 34, and a second transistor 54 having a base electrode connected to the collector electrode of the first transistor 53, having a collector electrode connected to the gate electrode of the SCR 12 in the discharge circuit of the lamp 11, and having an emitter electrode connected to the negative bus 34. With this first voltage detecting circuit, it is possible that when the voltage stored on the storage capacitor 5 is not yet above the satisfactory lamp firing level, the striking of the lamp 11 by the striking circuit 10 does not lead to initiate firing of the lamp 11 as the synchro-switch 40 is triggered or closed to initiate operation of the striking circuit 10.

The second voltage detecting circuit of the invention further includes a neon tube 8 equivalent in characteristics to the neon tube 51, a transistor 9 having a base electrode connected through the neon tube 8 to the junction point A of the resistance voltage divider 6, 7, having an emitter electrode connected to the positive bus, and having a collector electrode connected through a constant current circuit 33 to an interconnection terminal 36*a* by way of a lead 36, the terminal 36*a* being arranged to be connectable to an interconnection terminal 39*a* serving by way of a lead 39 as an input terminal of the diaphragm control circuit with a meter 41 when the flash unit is attached to the camera. The constant current circuit 33 comprises a variable resistor 33*a* and a field effect transistor 33*b* having a gate electrode connected to the collector electrode of the transistor 9, having a source electrode connected through the variable resistor to the gate electrode thereof, and having a drain electrode connected to the interconnection terminal 36*a* by way of the lead 36. Connected in parallel to the constant current circuit 33 are two field effect transistors 31 and 32 with their respective variable resistors 28 and 29 each connected between the gate and source electrodes of the respective transistor 31, 32 and both of which are arranged to cooperate with a guide number setting dial enclosed by two-dot and dash lines 23 provided on the housing of the flash unit. The guide number setting dial 23 is provided with a movable disc 24 carrying a film speed scale for a stationary index 25 and also a diaphragm value scale for an index 27 cut on a movable arcuate plate 26 concentric to the disc 24. The sensitivity in ASA of the film used upon selection on the disc 24 with the index 25 is introduced into the variable resistor 29 through a mechanical linkage schematically shown by a dashed line, thereby the transistor 32 is caused to provide a current, i2 while the diaphragm value selected by moving the arcuate plate 26 in reference to the disc 24 is introduced into the variable resistor 28 and also into the filter 18 through respective mechanical linkages schematically shown by dashed lines, thereby the transistor 31 is caused to provide a current, $i_1$, and the filter 18 is adjusted in position to provide a particular value of density.

The diaphragm control circuit within the dashed outline C comprises a meter 41 having a pointer 41 cooperative with a scanning member not shown, the coil of the meter 41 being connected between leads 37 and 39, a constant current circuit 42 connected in parallel to the coil of the meter 41, a light-emitting diode 43 for indicating whether or not the voltage of the storage capacitor 5 has attained the satisfactory lamp firing level, and a resistor 44 connected at one end to the lead 39, the opposite end of which is connected to the cathode of the diode 43. The constant current circuit 42 comprises variable resistor 42*a* and a field effect transistor 42*b* having a source electrode connected to the lead 37, having a gate electrode connected to the anode of the diode 43, and having a drain electrode connected through the variable resistor 42*a* to the gate electrode thereof. The aforesaid synchro-switch 40 is connected between the leads 37 and 38 and arranged to be closed when a shutter release button 45 is depressed to the second stroke.

The operation of the circuit of FIG. 1 is as follows: Upon attachment of the flash lighting unit to the camera, the terminals 34*a*, 35*a* and 36*a* of the lamp firing circuit F are brought into electrical connection with the terminals 37*a*, 38*a* and 39*a* of the diaphragm control circuit C respectively. Next, the operator may turn the guide number dial 23 at the disc 24 to place a graduation on the film speed scale representing the sensitivity of the film used in the camera, in this instance, ASA 100 in registry with the stationary index 25, and then turn at the arcuate plate 26 to place its index 27 in registry with a graduation on the diaphragm scale representing the given flash lamp diaphragm aperture, in this instance F=5.6, thereby the filter 18 is also moved automatically to place a filter patch corresponding to F=5.6, in this instance, 18*b*, in front of the photosensitive element 20.

When the power supply switch 2 is closed, the battery 1 of low voltage after increased by the voltage boosting means 3 begins to charge the storage capacitor 5 to gradually increasing voltages. When the voltage stored on the storage capacitor 5 has reached a satisfactory lamp firing level as determined by adjustment of the variable resistor 7, the voltage detecting means of the invention is actuated to render conducting the first and second neon tubes 51 and 8 simultaneously.

As the first neon tube 51 is conducting, the first voltage detecting circuit with the conducting transistor 53 and non-conducting transistor 54 functions to break the short-circuiting of the gate electrode of the lamp 11 discharge control SCR 12 from the negative bus 34, thereby the lamp 11 is made ready to fire at the time of striking of the lamp 11.

As the second neon tube 8 is conducting, the voltage of the battery 1 is applied to the meter 41 through the switching transistor 9 and the three field effect transistors 31, 32 and 33. Now assuming that the variable resistors 42*a* is previously adjusted so that the current flowing through the field effect transistor 42*b* becomes equal in magnitude to that flowing through the field effect transisor 33*b*, the current flowing through the coil of the meter 41 is equal to the sum of currents $i_1$ and $i_2$, flowing through the field effect transistors 31 and 32 respectively, depending upon the combined resistance values of the variable resistors 28 and 29. Thus, the position of the deflected pointer 41*a* depends upon the sensitivity of the film used and the flash lamp diaphragm aperture value.

When the shutter release button 45 provided on the camera housing is depressed to the first stroke, the position of the pointer 51 is scanned by the scanning member and the scanning result is introduced into a lens aperture mechanism of the camera where it is translated into the proper diaphragm aperture value corresponding to the guide number of F=5.6, ASA 100. Upon further depression of the button 45 to the second stroke, the synchro-switch 40 is closed to initiate operation of the striking circuit 10 by way of the leads 34 and 35. At this time, transistor 61 is turned on to apply the voltage of the capacitor 64 to the gate of the thyristor 66. Such conduction of thyristor 66 causes the closing of the SCR 12 and in turn causes flow of a transient current in the primary of the transformer 70 providing a high voltage on the secondary to strike the lamp 11 at the trigger electrode thereof, thereby a very high current is drawn from the storage capacitor 5 through the lamp 11 and the SCR 12, and the lamp 11 emits an extremely intense flash of light for a time duration dependent upon the level of brightness of the object 19 being photographed with such flash illumination. In other words, when the total amount of flash light reflected from the object as sensed by the photosensitive element 20 and integrated by the integrator 21 has reached a predetermined leve, the commutation capacitor 13-discharge control SCR 17 is closed (that is, conducting) to apply a positive potential to the cathode of the lamp 11, thereby the duration of firing of the lamp 11 is terminated. In a time interval after such a discharge through the lamp 11, the shutter is closed to terminate the flash exposure.

Now assuming that the synchro-switch 40 is closed when the voltage of the storage capacitor 5 is between the satisfactory lamp firing level and the lamp breakdown voltage level, the first and second neon tubes 51 and 8 remain in the non-conducting state while maintaining the gate and cathode of the SCR 12 short-circuited by the turned-on transistor 54 so that the lamp 11 is not caused to fire despite of the striking of the lamp 11.

The circuit of FIG. 1 may be modified in many ways. For example, an indicator may be connected across the resistor 44 of the diaphragm control circuit C to indicate whether or not the perfect interconnection between the two pairs of terminals 34*a*, 36*a* and 37*a*, 39*a* is established. Further, the voltage across the resistor 44 may be utilized in displaying a value of shutter speed. Though this embodiment has been described as employing the constant current circuit 33, this circuit may be omitted provided that the voltage of the battery 1 is stabilized. Assuming likewise again that the voltage of the battery 1 does not vary, there is no need to provide the constant current circuits for the variable resistors 28 and 29.

Figure 2:
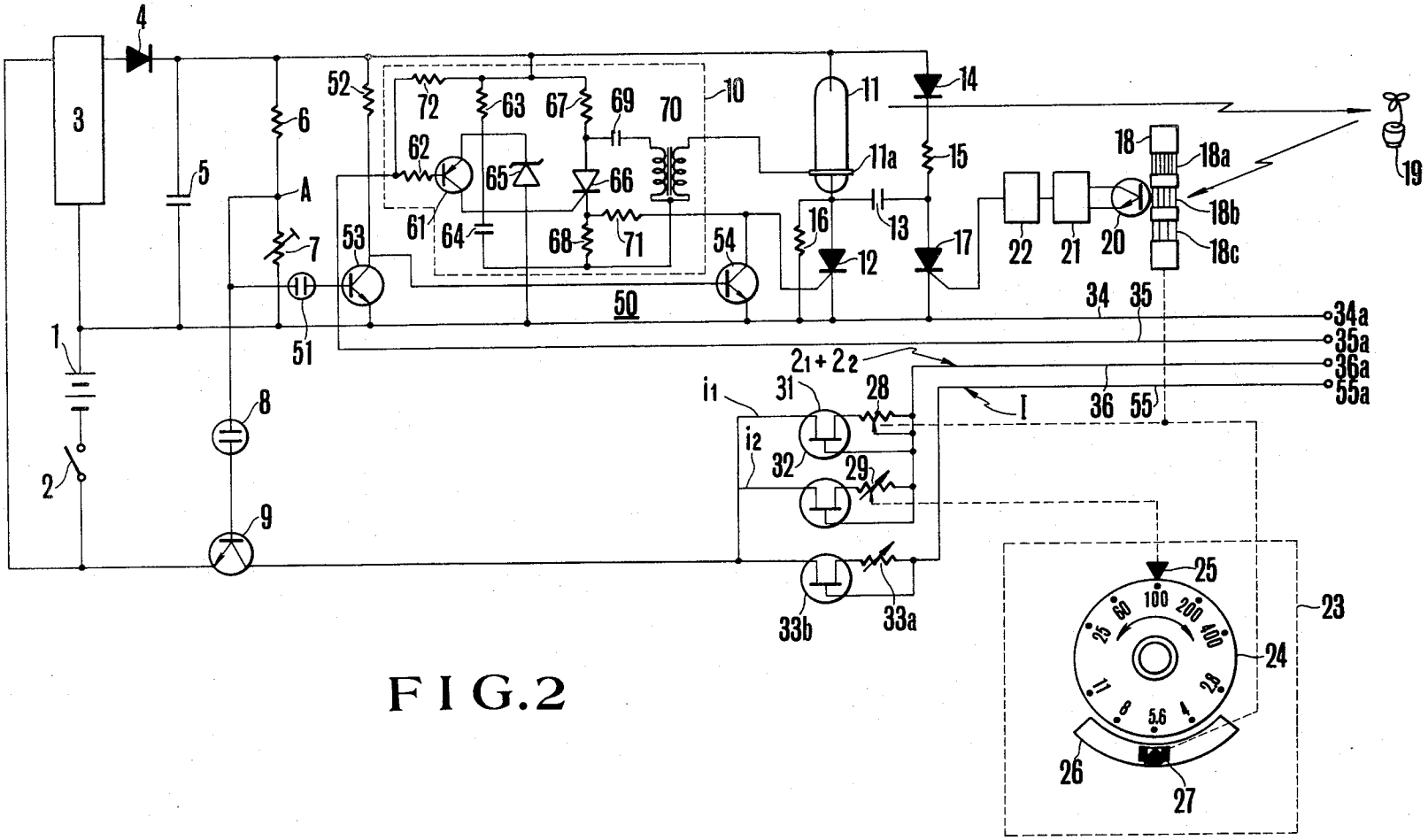
FIG. 2 is a circuit diagram, partly in block form, of another embodiment of a flash lighting unit according to the present invention adapted for use with a camera having an electronic switch for selecting either of automatic day-light and automatic flash exposure ranges.
Figure 3:
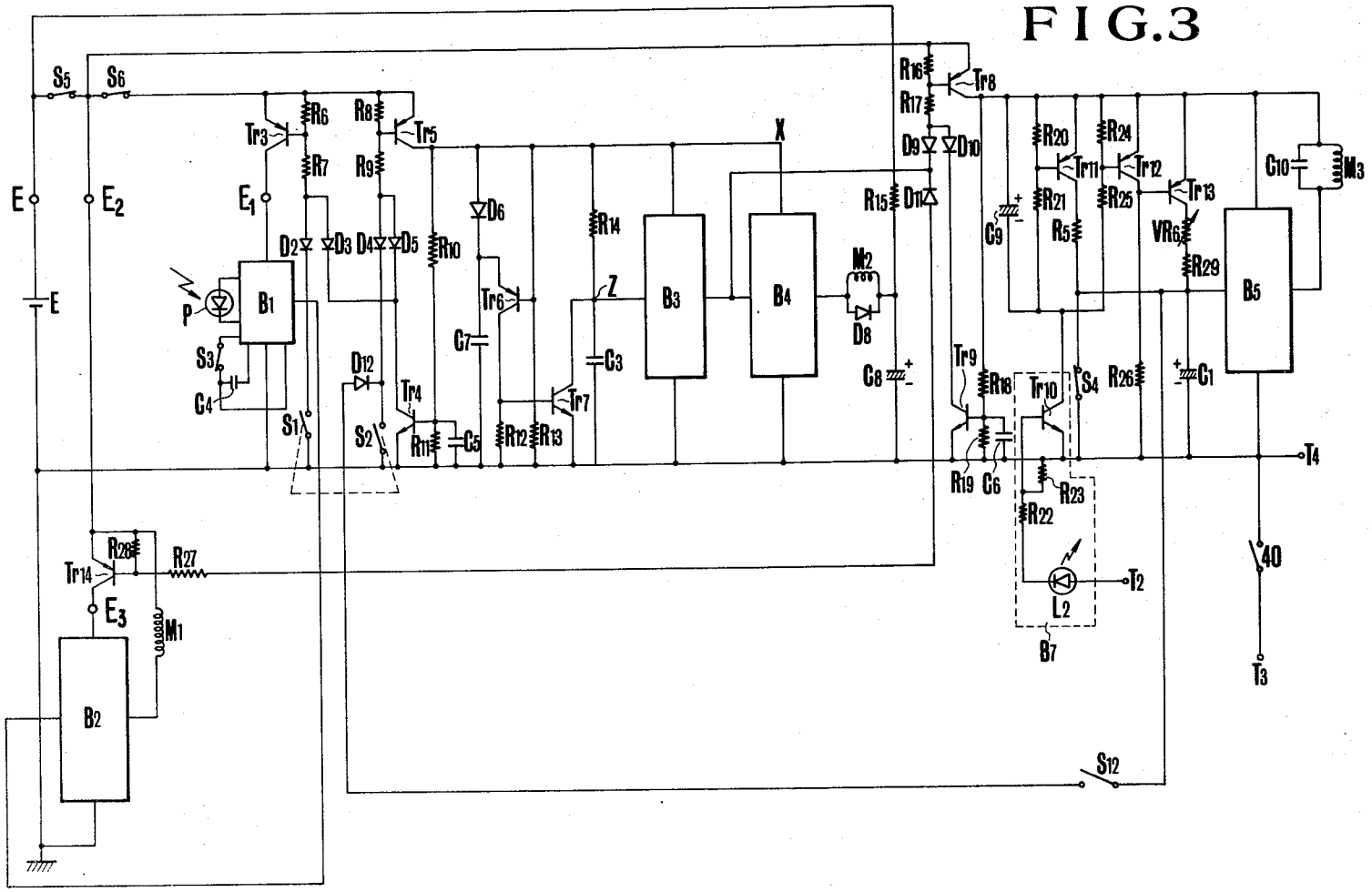
FIG. 3 is a circuit diagram, partly in block form, of an example of an automatic exposure control circuit usuable with the flash lamp firing circuit of FIG. 2.
Figure 4:
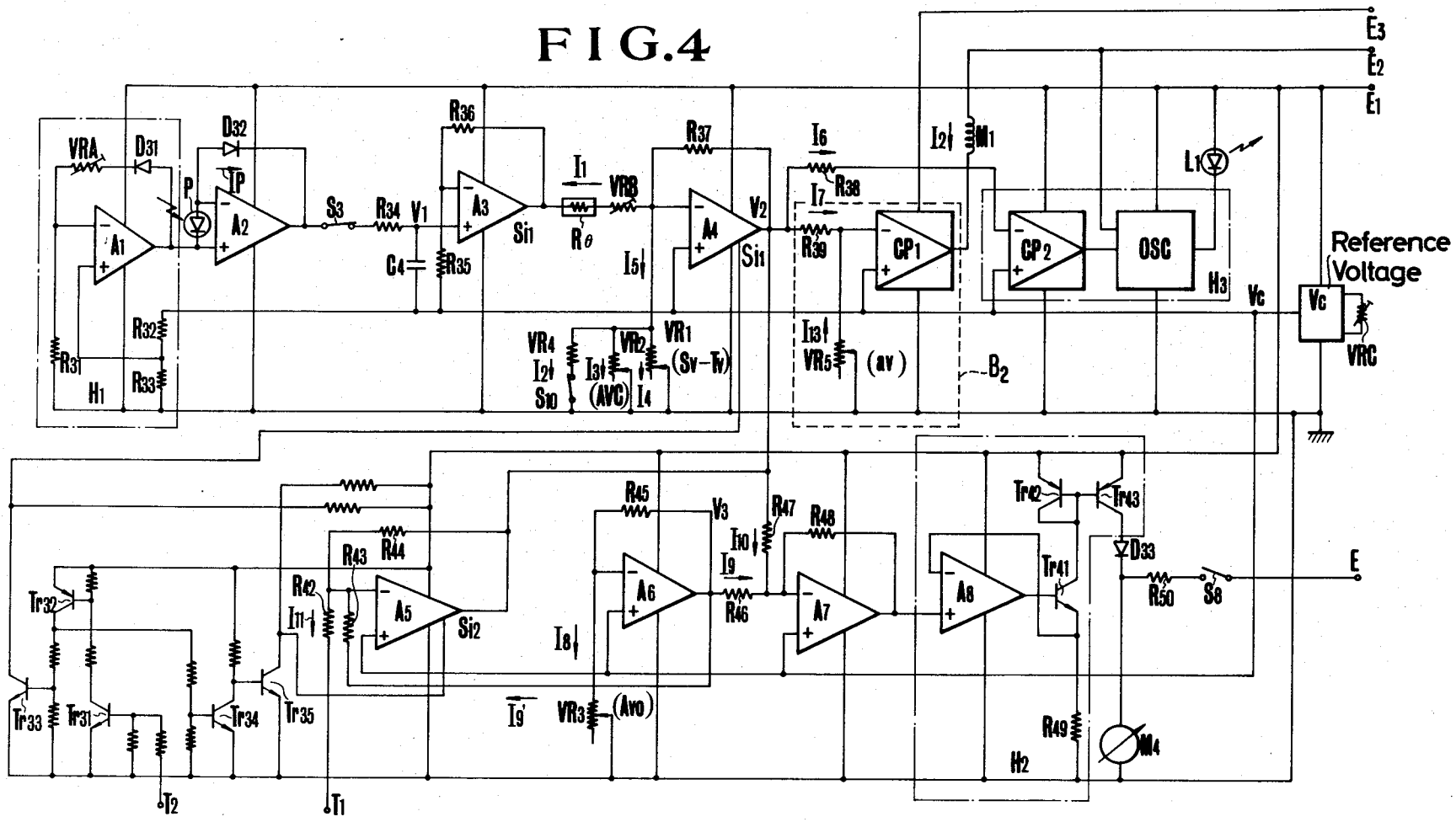
FIG. 4 is a circuit diagram showing the details of blocks B1 and B2 of FIG. 3.

FIG. 2 shows another embodiment of the flash lamp firing circuit according to the present invention adapted for use with a camera equipped with an automatic daylight exposure range and an automatic flash exposure range as shown in FIGS. 3 and 4. This embodiment is different from FIG. 1 embodiment in that the constant current circuit 33 is provided with an independent interconnection terminal 55*a* as separated from the terminal 36*a*. In FIG. 2, the same reference characters have been employed to denote similar parts to those shown in FIG. 1.

Referring to FIGS. 3 and 4, there is shown an example of an exposure control circuit of the shutter preselection automatic diaphragm control type usuable with the flash lamp firing circuit of FIG. 2. Interconnection terminals T1, T2, T3 and T4 of FIGS. 3 and 4 are arranged in a common shoe on the camera housing to be connectable with the terminals 36*a*, 55*a*, 35*a* and 34*a* respectively when the flash unit is attached to the camera at the shoe. The exposure control circuit comprises a source of power or battery E, an exposure value computing circuit (a photosensitive element P, a block B1 to be described in detail later, an exposure value storing capacitor C4) with a power supply control circuit therefor (a transistor Tr3, resistors R6 and R7, diodes D2 and D3), a diaphragm control circuit B2 responsive to the output of the block B1 for controlling actuation of a diaphragm electromagnet M1 with a power supply control circuit therefor (Tr14, R27, R28, D11), a trigger circuit block B3 of a conventional bistable circuit having an output terminal connected through the diode D11 and the resistor R27 to the base electrode of the transistor Tr14, a gate circuit block B4 of a conventional monostable multivibrator responsive to the output of the block B3 for energizing and deenergizing the solenoid of a camera release actuation electromagnet M2 with a diode D8 from a transient power storage capacitor C8 connected through a charging resistor R15 to the battery E, a power supply control circuit for blocks B3 and B4 (Tr5, R8, R9, D4, D5) with a common holding circuit (R10, R11, Tr4, C5) of that for B1, first and second timing circuits for day-light and flash exposure ranges respectively with a common power supply circuit (Tr8, Tr9, R16, R17, R18, R19, C6, D9, D10), a switching circuit B5 selectively responsive to the first and second timing circuits for controlling operation of a shutter electromagnet M3 with a capacitor C10, a changeover circuit with an actuating circuit B7 therefor responsive to the output of the flash lamp energy storage capacitor voltage detecting circuit of the invention for selecting the operating ranges of the camera, that is, either of the first and second timing circuits for connection with the block B5, and coordinating control means for those circuit portions (S1, S2, S3, S4, Tr6, Tr7, R12, R13, R14, C3, C7, D6).

The first timing circuit comprises a variable resistor VR6 cooperative with a shutter speed setting dial not shown, a fixed resistor R29 connected in series to the resistor VR6, and a timing capacitor C1 connected in series to the resistor R29, a junction point between the resistor R29 and the capacitor C1 being connected to the input terminal of the switching circuit B5 for the shutter electromagnet M3. The second timing circuit comprises a fixed resistor Rs and the common timing capacitor C1 of the first timing circuit, a junction point between the resistor Rs and the capacitor C1 being connected to the common input terminal of B5. The second timing circuit is designed to provide a particular time interval, for example, 1/60 second suited for flash photography.

The changeover circuit comprises a first transistor Tr11 connected between the collector electrode of the transistor Tr8, or the positive bus and the resistor Rs, a second transistor Tr12 connected between the positive bus and the resistor 26, and a third transistor Tr13 connected between the positive bus and the variable resistor VR6 and having a base electrode connected to the collector electrode of the transistor Tr12, the base electrodes of the transistors Tr11 and Tr12 being connected to respective junction points between resistors R20 and R21 and between resistors R24 and R25 and these two pairs of series-connected resistors being connected between the positive bus and a common collector electrode of a transistor Tr10 constituting part of the actuating circuit B7. In order to stabilize conduction of the transistor Tr10 against instantaneous non-conduction which may be encountered when the flash lamp is to initiate firing, there is provided a capacitor C9 connected between the positive bus and the collector electrode of the transistor Tr10. Connected across the timing capacitor C1 is a start switch S4 arranged to be opened when the front curtain of the shutter runs down to the fully open position.

The operation of the circuit of FIG. 3 is as follows. The camera having the same is assumed to be in the cocked position where switches S5 and S6 are closed and to operate without the flash unit so that the second timing resistor Rs is cut off from B5 and instead the first timing variable resistor VR6 is brought into cooperation with the timing capacitor C1 and B5 as the non-conduction of the transistor Tr10 results in conduction of the transistor Tr13.

When the shutter release button is depressed to a first stroke to close switch S1, transistor Tr3 is rendered conducting so that photosensitive element P receiving light through a photographing lens from a scene being photographed produces an output voltage proportional to the level of brightness of the scene and which is then stored on the memory capacitor C4 through a memory switch S3. Upon further depression of the shutter button to a second stroke, switches S2 is closed, causing transistor Tr5 to be turned on and in turn causing transistor Tr4 to be turned on so that even after the operator has removed his finger from the shutter button to open both of switches S1 and S2, transistors Tr3 and Tr5 are maintained in the conducting state. At the initiation of power supply to blocks B3 and B5, a timing circuit comprising a fixed resistor R14 and a capacitor C3 and serving as a delay circuit for a coordinating control begins to generate a time variable voltage which is capable of reaching a trigger voltage for the bistable circuit B3 during an interval of time, for example, 10 milliseconds. Responsive to the output of B3, the monostable multivibrator B4 produces a rectangular shaped actuating pulse which is applied to the solenoid of electromagnet M2, thereby a not shown diaphragm scanning device and a not shown mirror drive mechanism are rendered operative to open the memory switch S3. The output of B3 is also applied to the power supply control circuit for the diaphragm control circuit B2. When the size of diaphragm aperture in the lens aperture mechanism as determined by the scanning device has reached a level dependent upon the output of B1, that is, the computed exposure value, the electromagnet M1 is deenergized to arrest the diaphragm scanning device. Thus, the exposure value is translated into the proper diaphragm aperture value. As the conduction of transistors Tr8 and Tr9 by the output of B3 is followed by the opening of the start switch S4 caused by the running-down movement of the front shutter curtain occurring at the time when the reflex mirror has reached the terminal of upward movement, the first timing circuit VR6, R29 and C1 begins to generate a time variable voltage capable of reaching a trigger level for B5 during an interval of time dependent upon the preselected shutter speed. When B5 is turned on, shutter electromagnet M3 is energized causing the rear shutter curtain to run down to terminate the exposure, and causing switch S5 to open, thereby all the power supply control switching transistors Tr3, Tr5, Tr8 and Tr14 are rendered non-conducting. By the provision of these power supply control circuits, it is made possible to minimize consumption of electrical energy of the battery E.

For flash photography, the flash lamp firing circuit of FIG. 2 will be connected to the exposure control circuit of FIG. 3. After having the guide number dial adjusted, the operator may close the main switch 2 of the flash unit to charge the storage capacitor 5. When the voltage stored on the capacitor 5 has reached the satisfactory lamp firing level, the neon tube 8 is rendered conducting to turn on the transistor 9 so that the voltage of the battery 1 is applied through the pair of interconnection terminals 34*a* and 55*a* with respective terminals T4 and T2 to the actuating circuit B7. At this time, the diode L2 emits light so that the operator is immediately informed of the fact that the flash lamp 11 is ready to fire with the sufficient voltage. As the transistor Tr10 is in the conducting state, the transistor Tr12 is conducting, and transistor Tr13 is non-conducting so that the first timing circuit for day-light photography is cut off from the switching circuit B5, but instead the second timing circuit is brought into connection with B5 as the transistor Tr11 is conducting. Subsequent operation proceeds in a manner similar to that described in connection with day-light photography. At the time when the entire area of an exposure aperture is unblocked as the front shutter curtain runs down, the synchro-switch 40 is closed to strike the flash lamp 11.

To switch the diaphragm control circuit B2 from being responsive to the output of the exposure value computing circuit B1 to being responsive to the output of the guide number setting variable resistors 29 and 29, in automatic response to the attainment of the voltage of the storage capacitor 5 to the satisfactory lamp firing level, there is provided an additional transistorized changeover circuit in the exposure control circuit of FIG. 3. This circuit will next be described in connection with the details of blocks B1 and B2 of FIG. 3 by reference to FIG. 4. The exposure value computing circuit B1 includes a logarithmic converter consisting of an operational amplifier A2 having a pair of input terminals between which the photosensitive element P is connected, and a feedback diode D32 connected between the inversion input and output of the amplifier A2, and a temperatur compensating circuit H (an operational amplifier A1, resistors R31, R32, R33, a variable resistor VRA, a diode D31) having an output terminal connected to the non-inversion terminal of the logarithmic converter A2, D32. The output of the logarithmic converter in the form of a voltage directly proportional to the logarithm of input current Ip supplied from the photosensitive element P is applied through the memory switch S3 and a flicker-preventing resistor R34 to the memory capacitor C4. The voltage V1 once stored on the memory capacitor C4 is amplified by a high input impedance buffer amplifier A3, and is then applied to a feedback summing amplifier comprising a temperature compensation resistor $R_\theta$, a variable resistor VRB connected in series to the resistor $R_\theta$, three variable-resistors VR1, VR2 and VR4 connected in parallel to each other and to the variable resistor VRB and having resistance values adjusted in conformance with a film speed(Sv)-to-shutter speed(Tv) difference (Sv−Tv), a full aperture correction factor (Avc) and an exposure correction factor (K) respectively, and an operational amplifier A4 with its feedback resistor R37. The output voltage V2 of the feedback summing amplifier represents a diaphragm value relative to the full open aperture value. This voltage V2 is applied to three circuit portions, one of which is a warning signal generating circuit H3 with a light-emitting diode L1 connected through an oscillator OCS to the output terminal of a comparator CP2 so that when the computed exposure value representing the relative diaphragm value as detected by the comparator CP2 falls below the minimumone available in the lens aperture mechanisim of the camera, the diode L1 is caused to intermittently emit light. Another circuit portion is a second feedback summing amplifier comprising a resistor R47 connected between the output terminal of the first-named summing amplifier A4 and an input terminal of an amplifier A7, and a resistor R46 connected in parallel to the resistor R47 and between an output terminal of a buffer amplifier A6 and the amplifier A7. The buffer amplifier A6 has a feedback resistor R45 and a variable resistor VR3 connected to an input terminal (−) thereof to introduce a full open aperture value (Avo) thereto, so that the output of the amplifier A7 represents an effective diaphragm value which is displayed by a meter M4 through a drive circuit H2 therefor (an operational amplifier A8, transistors Tr41, Tr42, Re43, a resistor M49). When a day-light exposure is to be made, as no voltage is applied to the terminal T2, the output of the first summing amplifier A4 is applied through a resistor R39 to an input terminal (−) of a comparator CP1 constituting part of the diaphragm control circuit B2 of FIG. 3. Also connected to the same input terminal of the comparator CP1 is a variable resistor VR5 cooperative with a diaphragm scanning member upon coincidence in magnitude of a current signal I13 from the variable resistor VR5 with a current signal I7 from the amplifier A4 for causing the comparator CP1 to deenergize the diaphragm electromagnet M1, whereby the output of the first summing amplifier A4 is translarted into a proper diaphragm aperture value in the lens aperture mechanism.

When a flash exposure is to be made, as the voltage stored on the storage capacitor 5 is above the satisfactory lamp firing level, the transistorizd changeover circuit Tr31 to Tr34 operates to turn off the amplifier A4 and instead to turn on an amplifier A5 so that a current signal I11 representing the selected guide number is combined with a current signal I9′ supplied from the amplifier A6, and the output of the amplifier A5 is supplied to the comparator CP1.

Consideration will next be given to the operating principles of the circuit of FIG. 4. For day-light photography without the flash lighting unit, the terminal T2 provides no voltage so that amplifiers A3 and A5 are in the operative and inoperative positions respectively. Upon depression of the shutter release button to the first stroke, the battery E1 is connected to the exposure value computing circuit B1 so that the photosensitive element P responsive to the intensity of light entering through the photographing lens with the maximum possible aperture value (Avo) produces a current signal Ip dependent upon the object brightness level (Bv). Responsive to the current signal Ip, the logarithmic converter A2 provides an output voltage signal V1 which is stored on the memory capacitor C4. This voltage signal V1 is applied through the high input impedance buffer amplifier A3, the temperature compensation resistor $R_\theta$ and the variable resistor VRB to the amplifier A4. Hence, one of input current signals for amplifier A4, namely, signal I1 may be expressed by the following formula $$I1 = \frac{-(V1 - Vc)}{R_\theta + VRB}\ ;\ I1 \propto Bv - Avc - Avo$$

wherein Vc is a reference voltage.

The variable resistors VR1, VR2 and VR4 provide current signals I4, I3 and I2 respectively with the magnitudes proportional to the difference between the film speed Sv and the shutter speed Tv, the full aperture correction factor (Avc) and K-factor and which may be expressed by the following formulae:

$$I2 = \frac{Vc}{VR4}\ I3 = \frac{Vc}{VR2}\ I4 = \frac{Vc}{VR1}$$

Hence, we have the input current signal for amplifier A4 as the sum of current I1 and I5, wherein I5=I2+I3-+I4, $$I1 + I5 = \frac{-(V1 - Vc)}{R_\theta + VRB} +$$

$$Vc\left(\frac{1}{VR1} + \frac{1}{VR2} + \frac{1}{VR4}\right) \propto Bv + Sv - Tv - Avo + K$$

and the output voltage signal V2 of amplifier A4 as expressed by $$V2=(I1+I5)\times R37+Vc$$

The voltage signal V2 is proportional to a difference between an effective diaphragm aperture value and the full open aperture value.

When the voltage V2 is larger than the reference voltage Vc and when a current signal $$\left(=\frac{V2 - Vc}{R38}\right)$$

flowing through the resistor R38 is equal to or larger than zero, the lens aperture mechanism is adjustable to provide an effective diaphragm aperture value in conformance with the output of the amplifier A4, so that the warning signal generating circuit H3 remains in the inoperative position where the light-emitting diode L1 does not emit light. However, when the current signal I6 is negative in magnitude, a warning signal is produced from the diode L1 as it is intermittently energized by the oscillator OSC.

In order for the diaphragm value meter M4 to display the effective diaphragm value, the voltage signal V2 is combined with a voltage signal V3 from the amplifier A6 by the second summing, amplifier A7. As the variable resistor VR3 is previously adjusted in accordance with the full open F-number of the lens, the magnitude of the voltage signal V3 may be expressed by $$V3=I8\times R45+Vc\ (\alpha Avo)$$

wherein I8 is the current signal from the VR3 and has a magnitude I8=Vc/VR3. The voltage signals V2 and V3 are combined with each other in the form of the sum of current signals I10 and I9 flowing through the resistors R47 and R47 respectively. Since $$I9 = \frac{R45}{R46} \times I8$$

(αAvoαFull open F-number), and $$I10 = \frac{V2 - Vc}{R47}$$

(αBv+Sv−Tv−Avo+KαRelative diaphram aperture value), we have the computed result representing the effective aperture value as follows $$I9 + I10 = \frac{R45}{R46} \times I8 + \frac{V2 - Vc}{R47} (\propto Bv + Sv - Tv + K)$$

The output of the amplifier A7 is applied to the drive circuit H2 for the meter M4.

Next, when the shutter button is depressed to the second stroke, the diaphragm electromagnet M1 is energized from a source of power E2. At this time, the turning signal generating circuit H3 is rendered inoperative, and the diaphragm scanning member begins to move with variation of the resistance value of variable resistor VR5. Since the input signal for the comparator CP1 is given by the sum of current signals I7 and I13 flowing through the resistors R39 and VR5, that is, $$I7 + I13 = \frac{V2 - Vc}{R32} - \frac{Vc}{VR5},$$

when I7+I13>0, the comparator CP1 is OW to maintain the electromagnet M1 energized with a current I2. When I7+I13≦0, the comparator CP1 is OFF to deenergize the electromagnet M1, thereby the scanning member is arrested.

It is to be noted that when the above-described computation is performed in terms of APEX, each current signal from the exposure control parameter setting variable resistor can take the form I=Vc/VR, wherein VR is the resistance value of the setting variable resistor. Assuming that the resistor is designed to provide a resistance value R as a function of R=Ro/θ, wherein Ro is the maximum resistance value, and θ is the amount of displacement of the slider of the variable resistor, when the reference voltage Vc is maintained constant, the magnitude of the current signal I becomes a linear function of the amount of displacement of the slider, that is, I=(Vc/Ro)×0, so that an arithmetic progression scale with equally spaced graduations may be employed for cooperation with the exposure control parameter setting dial.

In the case of flash photography, as the terminal T2 provides an actuating voltage for the changeover circuit Tr31 to Tr35, A4 is OFF and A5 is ON so that the comparator CP1 is rendered responsive to the current signal (i1+i2) of FIG. 1 supplied from the flash unit through the terminal T1.

What is claimed is:

1. A flash unit for a photographic camera comprising:
(a) flash lamp means;
(b) means for connection to a source of electrical power;
(c) a storage capacitor connected to said means for connection to a source of electrical power to store a voltage capable of reaching a satisfactory firing level for said flash lamp means; '(d) striking means connected to said flash lamp means and actuated by a synchronizing signal from said camera for initiating firing of said flash lamp means;
(e) voltage detecting means connected to said storage capacitor for detecting the voltage across said storage capacitor, said voltage detecting means having an output forming a charge completion signal;
(f) switching means connected between said flash lamp means and said storage capacitor for enabling said flash lamp to illuminate when said switching means turns on and disabling said flash lamp from illuminating when said switching means turns off;
(g) inhibiting means responsive to a charge completion signal from said voltage detecting means for making said switching means turns off when said voltage detecting means detects that the voltage of the storage capacitor is not enough to illuminate said flash lamp means;
(h) means for transmitting an output signal from the voltage detecting means to the inhibiting means; and
(i) said striking means being arranged to be operative irrespective of the charge completion signal.

2. A flash unit according to claim 1, wherein said switching means includes a thyristor.

3. A flash unit according to claim 2, wherein said means for making said switching means turn off includes a transistor connected to a gate of the thyristor.

* * * * *